United States Patent [19]

Kaschak et al.

[11] Patent Number: 4,623,554

[45] Date of Patent: Nov. 18, 1986

[54] METHOD FOR CONTROLLING PLATING RATE IN AN ELECTROLESS PLATING SYSTEM

[75] Inventors: Ronald A. Kaschak, Vestal; Roy H. Magnuson, Binghamton; Edward J. Yarmchuk, Purdys, all of N.Y.

[73] Assignee: International Business Machines Corp., Armonk, N.Y.

[21] Appl. No.: 709,955

[22] Filed: Mar. 8, 1985

[51] Int. Cl.[4] ..... C23C 18/16; C23C 18/40

[52] U.S. Cl. ..... 427/8; 427/9; 427/10; 427/98; 427/345

[58] Field of Search ..... 427/8, 9, 10, 98, 305, 427/345; 364/496, 500, 563, 565

[56] References Cited

U.S. PATENT DOCUMENTS

| | | | |
|---|---|---|---|
| 3,951,602 | 4/1976 | Thompson | 23/230 R |
| 4,055,751 | 10/1977 | Bussmann et al. | 364/500 |
| 4,096,301 | 6/1978 | Slominski et al. | 427/437 X |
| 4,276,323 | 6/1981 | Oka et al. | 427/8 |
| 4,320,463 | 3/1982 | Himmelstein | 364/552 |
| 4,326,940 | 4/1982 | Eckles et al. | 204/232 |
| 4,331,699 | 5/1982 | Suzuki et al. | 427/8 |
| 4,344,142 | 8/1982 | Diehr, II et al. | 364/473 |
| 4,479,980 | 10/1984 | Acosta et al. | 427/10 |

FOREIGN PATENT DOCUMENTS 1285693 8/1972 United Kingdom .

OTHER PUBLICATIONS

*Production Methods*, Circuits Manuf. (USA), vol. 18, No. 5, May 1978.

*Primary Examiner*—John D. Smith

*Attorney, Agent, or Firm*—Pollock, Vande Sande & Priddy

[57] ABSTRACT

Method for controlling plating in an electroless plating process. The plating rate is continuously monitored. The plating rate is compared with a set point plating rate. A control voltage is derived proportional to the difference in plating rate and the desired plating rate, the integral of the difference, and the derivative of the difference. The control voltage is applied to a replenishment control for controlling the replenishment rate of a constituent chemical of the plating process.

9 Claims, 6 Drawing Figures

METHOD FOR CONTROLLING PLATING RATE IN AN ELECTROLESS PLATING SYSTEM

BACKGROUND OF THE INVENTION

The present invention relates to the electroless plating art. Specifically, a method is provided for controlling the replenishment rate of a plating solution constituent chemical component during electroless plating.

Large multi-layer circuit boards are formed by electroless plating copper on circuit traces on the circuit board. In order to maintain the quality of the copper deposit, the rate of copper deposition should be maintained substantially constant. Prior art techniques for controlling the rate of copper deposition include controlling a number of chemical parameters such as temperature, pH, copper concentrations, cyanide concentration and formaldehyde concentration. At intervals of approximately one hour, a determination of plating rate is made by measuring the weight gain of a copper coupon suspended in the plating bath. The operator uses the weight gain measurement to adjust the set point of a formaldehyde controller in order to obtain a desired plating rate. The time between rate measurement and the difficulty of manually determining the right formaldehyde concentration to achieve a given plating rate results in uncertain quality control over the plating deposition rate, and ultimately the quality of the metallic deposit.

SUMMARY OF THE INVENTION

The present invention provides a method for controlling the concentration of a constituent chemical component of an electroless plating bath. The invention is implemented to control a reservoir of the constituent component by continuously monitoring the plating rate of the electroless bath during plating operations. A control voltage is derived from this plating rate for controlling the replenishment rate of the constituent component.

In a preferred embodiment of the invention, the constituent component to be controlled is formaldehyde. A control voltage for operating a reservoir controller is derived from the plating rate of the plating bath. The control voltage is formed by combining first, second and third feedback terms, the first feedback term being proportional to the difference between the present plating rate and a desired rate. The second feedback control term is proportional to the integral of the first feedback term. The third feedback term is proportional to the time derivative of the first feedback term. The derived control voltage is applied to the controller for establishing a replenishment rate.

The preferred embodiment of the invention is implemented with a computer controller which will permit other forms of replenishment control at the discretion of the operator. Further, the rate uncertainty is verified by the computer prior to calculating feedback control terms. The computer will output to a display or printer any excessive plating rate uncertainties.

DESCRIPTION OF THE PREFERRED EMBODIMENT

Figure 1:
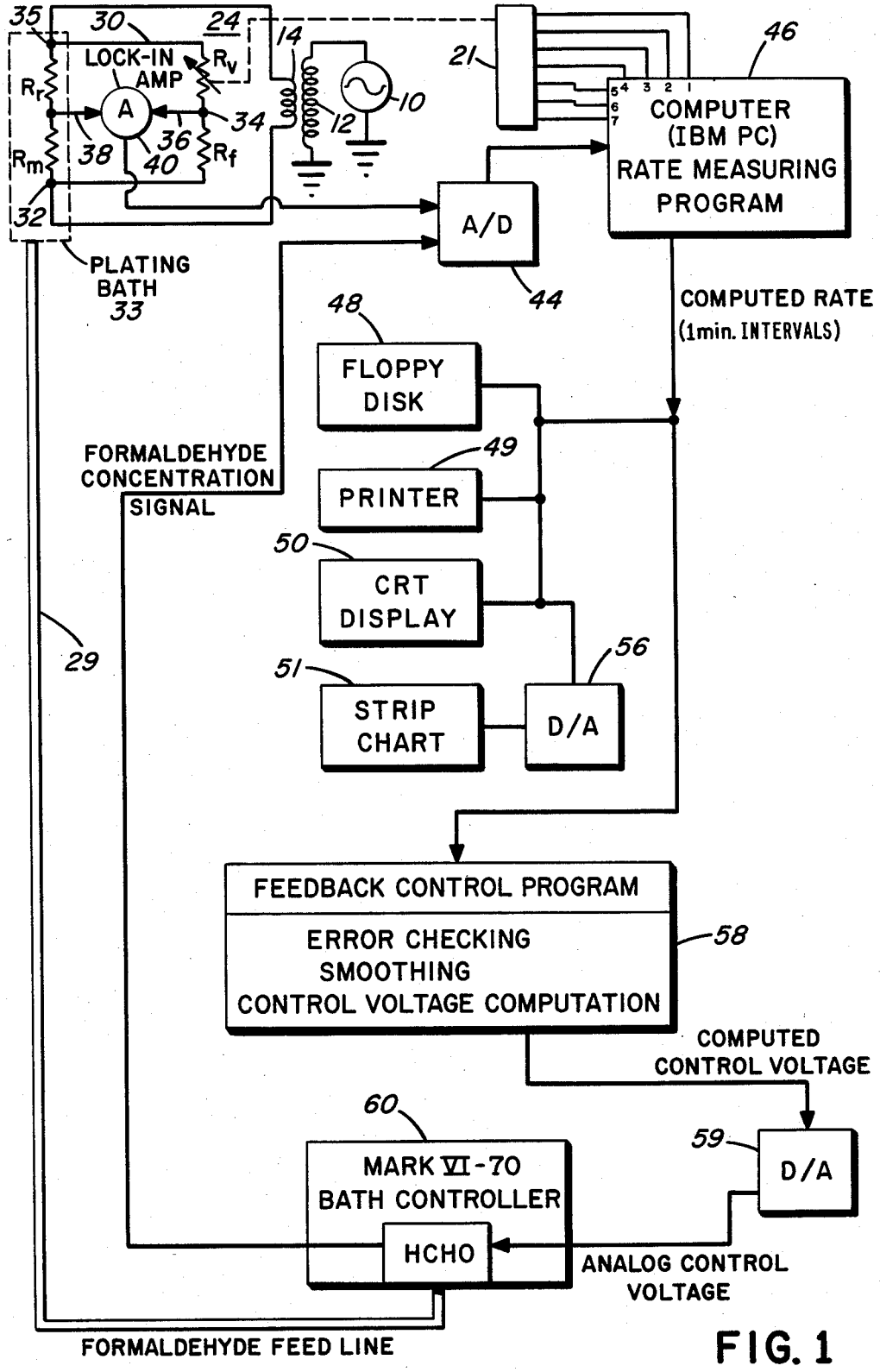
FIG. 1 is an overall system block diagram for carrying out the preferred embodiment of the invention.

Referring now to FIG. 1, there is shown apparatus for carrying out one embodiment of the invention. FIG. 1 is a block diagram of a system which controls formaldehyde replenishment in a plating bath 33. The system of FIG. 1 includes a rate monitoring device 24 comprising a wheatstone bridge 30, driven by a transformer 14 and audio oscillator 10. Wheatstone bridge 30 includes two arms $R_r$ and $R_m$, immersed in the plating bath 33. A change in resistance of the resistor $R_m$ occurs as the resistor $R_m$ experiences plating within the plating bath 33. Changes in the resistance $R_m$ are detected as a plating rate. Amplifier 40 provides an output proportional to the voltage between terminals 34 and 38 of the bridge. The plating rate detector 24 is connected to an analog to digital converter 44 wherein the voltage measurements of amplifier 40 are digitalized for analysis by the computer 46.

The foregoing plating rate detector is the subject of another patent application of the present assignee, Ser. No. 562,390, filed Dec. 16, 1983, now U.S. Pat. No. 4,479,980, hereby incorporated by reference. Briefly, the subject matter of this patent application describes a wheatstone bridge 30 which is brought out of balance by stepping resistor $R_v$ under the control of computer 46. Computer 46 will, at one minute intervals, step the value of $R_v$ by applying an 8 bit stepping signal to interface 21. Interface 21 provides, at an output, a resistance proportional to the 8 bit binary digit applied to interface 21. The signal applied to the wheatstone bridge 30 is received from an audio oscillator 10. A transformer having a primary winding 12 is connected to the audio oscillator 10 and the secondary 14 thereof applies a signal across terminals 32 and 35 of the bridge 30. The bridge 30 is initially put out of balance by increasing $R_v$ sufficiently to achieve an unbalanced condition as monitored by amplifier 40. As plating commences, the value of $R_m$ will decrease and the bridge will eventually come into balance during a time interval A. The bridge is then put into a second unbalanced condition for a second B interval by computer 46 adding a known resistance value step increase through interface 21 to resistor $R_v$. As set forth in the aforementioned patent application, the time to the next balanced condition achieved through plating of resistor $R_m$ is measured. During the subsequent B interval, measuring the time between the initial unbalance of bridge 30 and its rebalancing condition due to plating, a change in thickness is determined, $\Delta t$, according to $$\Delta t = \frac{P_m L_m}{W_m R_r} \times \frac{250}{R_f}$$

where $P_m$ equals the resistivity of $R_m$; $L_m$ is the length of rectangularly shaped $R_m$; $W_m$ is the width of rectangularly shaped $R_m$; $R_r$ is the measured resistance of a reference line in the bath; 250 is the step increase in $R_v$, and $R_f$ is by way of example, 10,000 ohms.

Thus, the change in plating thickness $\Delta t$ having been determined, and the time during which the $\Delta t$ change in thickness is known as interval B, an accurate determination of the plating rate as $\Delta t/B$ is known. As any other object located within plating bath 33 will be plated at the same rate, an effective measure of the plating rate is determined with bridge 30, analog to digital converter 44 and the computer 46. The computer 46 may be a standard IBM Personal Computer programmed in a manner to be explained.

Thus, the plating rate may be determined in at least one minute intervals by a continuous deliberate unbalancing of the bridge 30 by a distinct binary resistance step increase in $R_v$ controlled by the computer. The time in which the bridge achieves a balance is accurately measured, permitting the plating rate to be determined.

In accordance with the present invention, the above-plating rate detection is useful for determining a control voltage for establishing a formaldehyde replenishment rate to the plating bath 33. The present invention incorporates modifications to the programming steps of computer 46 as described in the aforementioned co-pending patent application in order to derive a replenishment control voltage.

Additional to the computer 46 are conventional peripheral devices including a floppy disc 48, a printer 49, and a cathode ray tube display 50. In the system of FIG. 1, a strip chart recording device 51 is connected through digital to analog converter 56 to the computer. With the strip chart recorder 51 it is possible to record the plating rate determined over time, as well as the temperature or any other parameter measurements which may be available.

The control voltage for controlling the formaldehyde replenishment rate is derived by a feedback control program 58, stored on the floppy disc 48, along with the rate determining program utilized in computer 46.

The computer 46 will provide a digital signal indicative of a formaldehyde replenishment rate. Digital to analog converter 59 will convert the derived replenishment rate into an analog control voltage for a Mark VI-70 bath controller 60. The Mark VI-70 bath controller 60, known to those skilled in the plating art, provides for replenishment of formaldehyde to a plating bath 33 in accordance with an applied voltage. The Mark VI-70 bath controller 60 additionally includes a formaldehyde concentration control signal which may be set to provide a constant formaldehyde concentration regardless of plating rate. This formaldehyde concentration signal, available from the Mark VI-70 bath controller 60, is applied to analog to digital converter 44. The computer can control the formaldehyde replenishment rate in accordance with either the measured plating rate or by merely connecting a signal to the bath controller 60 from the formaldehyde concentration signal available from the Mark VI-70 bath controller 60.

With the system of FIG. 1, the operator selects by pressing one of the three keys, R, F and S, the mode of operation for the system. When the operator presses the S key, the computer will prompt him to enter a plating rate set point number. This will provide a nominal plating rate by which to compare the measured plating rate. The feedback control program will generate the required computed control voltage by comparing the set point plating rate with the actual measured plating rate.

When the F key on the keyboard is selected by the operator, the computer 46 will act as a connection between the formaldehyde concentration signals of Mark VI-70 bath controller 60 to the control input of the Mark VI-70 bath controller 60, thereby controlling replenishment strictly in accordance with a formaldehyde concentration signal available from the Mark VI-70 bath controller 60.

With the system depicted in FIG. 1, it is possible to provide for automatic continuous plating control by adjusting the formaldehyde replenishment rate. By merely selecting a desired plating rate, the automatic feedback circuitry provided by FIG. 1 controls the plating rate through formaldehyde replenishment control. Maintaining the plating rate at a constant selected level established by the set point plating rate provides for control over the quality of the plating deposit, copper in the case of circuit boards, in an electroless additive bath plating system.

Figures 3, 4:
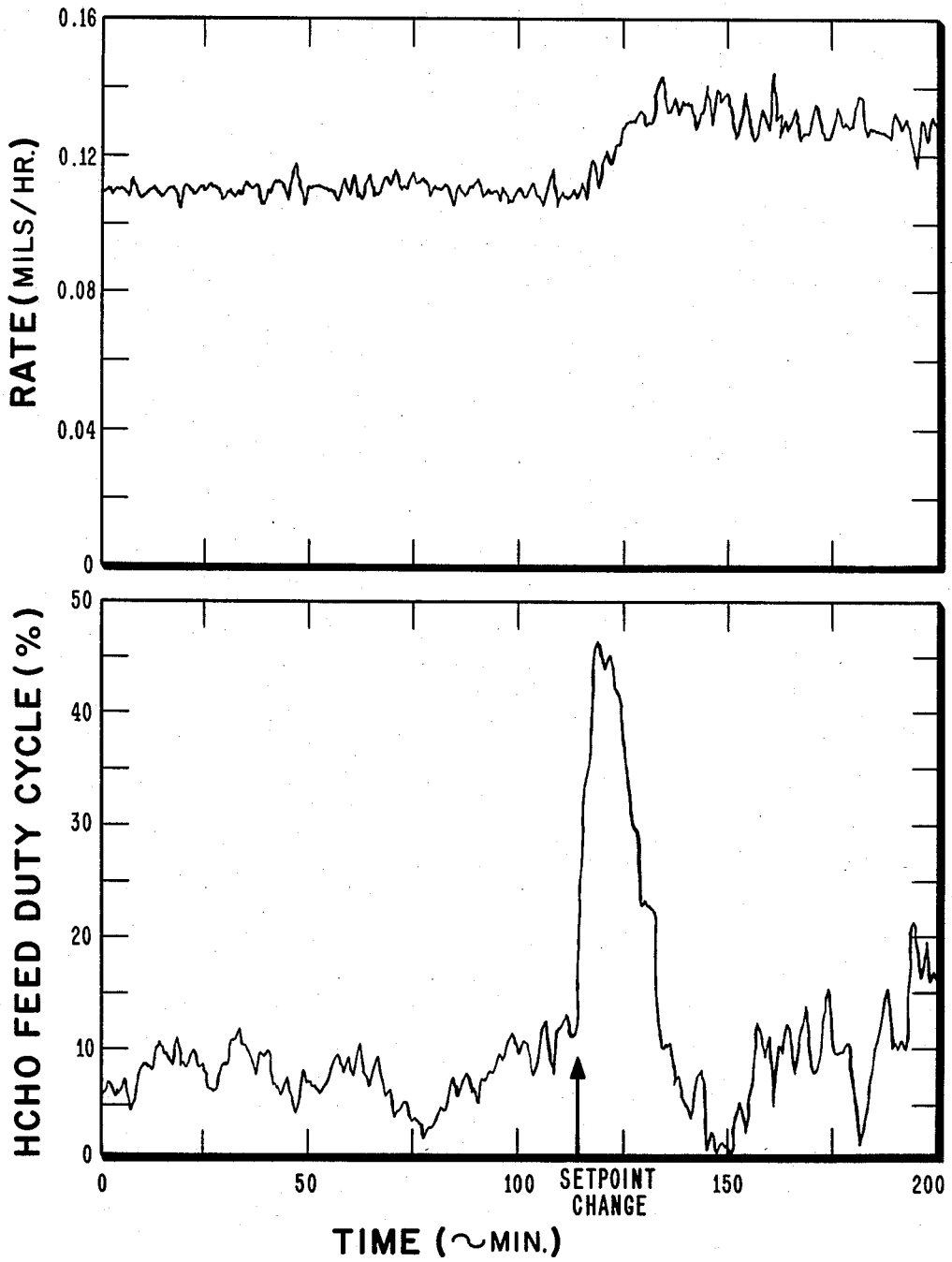
FIG. 3 illustrates the change in plating rate where a plating rate set point change is entered in the system.
FIG. 4 illustrates the effect of the plating rate set point change on the duty cycle of the Mark VI-70 formaldehyde controller.

The system performance is demonstrated more particularly in FIGS. 3 and 4 which illustrate the plating rate as a function of two set points keyed into the system. FIG. 3 demonstrates a plot of the plating rate versus time for two separate settings of set points. The first set point was set at 0.11 mils per hour of plating and the second set point was established at 0.13 mils per hour. It is clear from FIG. 3 that the system provides for a plating rate maintained within a narrow range of values around the set point.

In FIG. 4, the duty cycle for the Mark VI-70 bath controller 60 is shown over time. FIG. 4 is time coincident with FIG. 3 and the change in set point can be seen to increase the duty cycle for the formaldehyde feed such as to obtain the new plating rate of the new set point. Thus, the system provides for control over plating rate which is not subject to the tedious manual adjustments of the bath chemical constituents as was required in the prior art systems, and which remains stable over time.

Figure 2A:
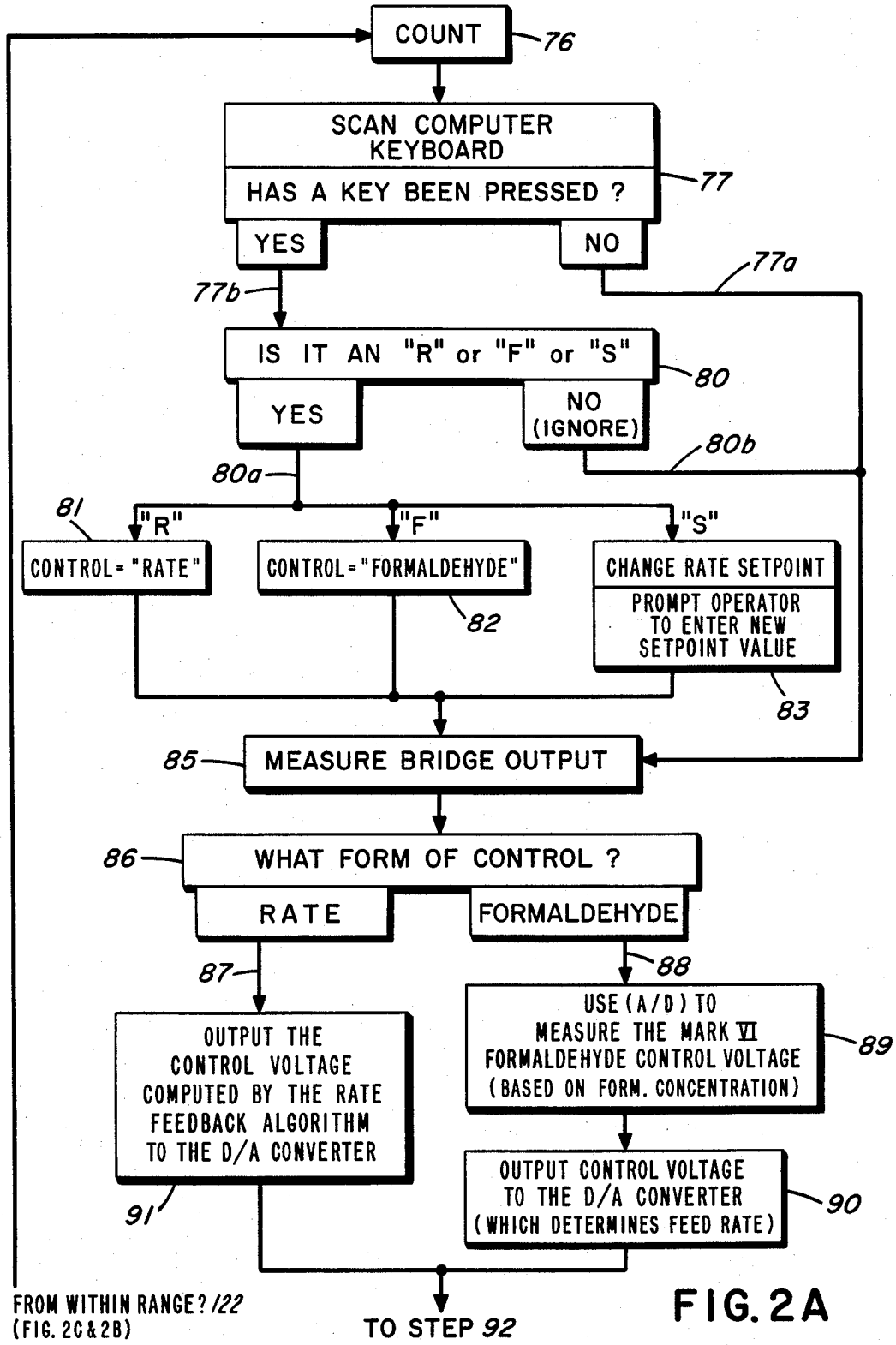
FIG. 2A, 2B and 2C illustrate the programming steps of coomputer 46 in carrying out the preferred embodiment of the invention.
Figure 2B:
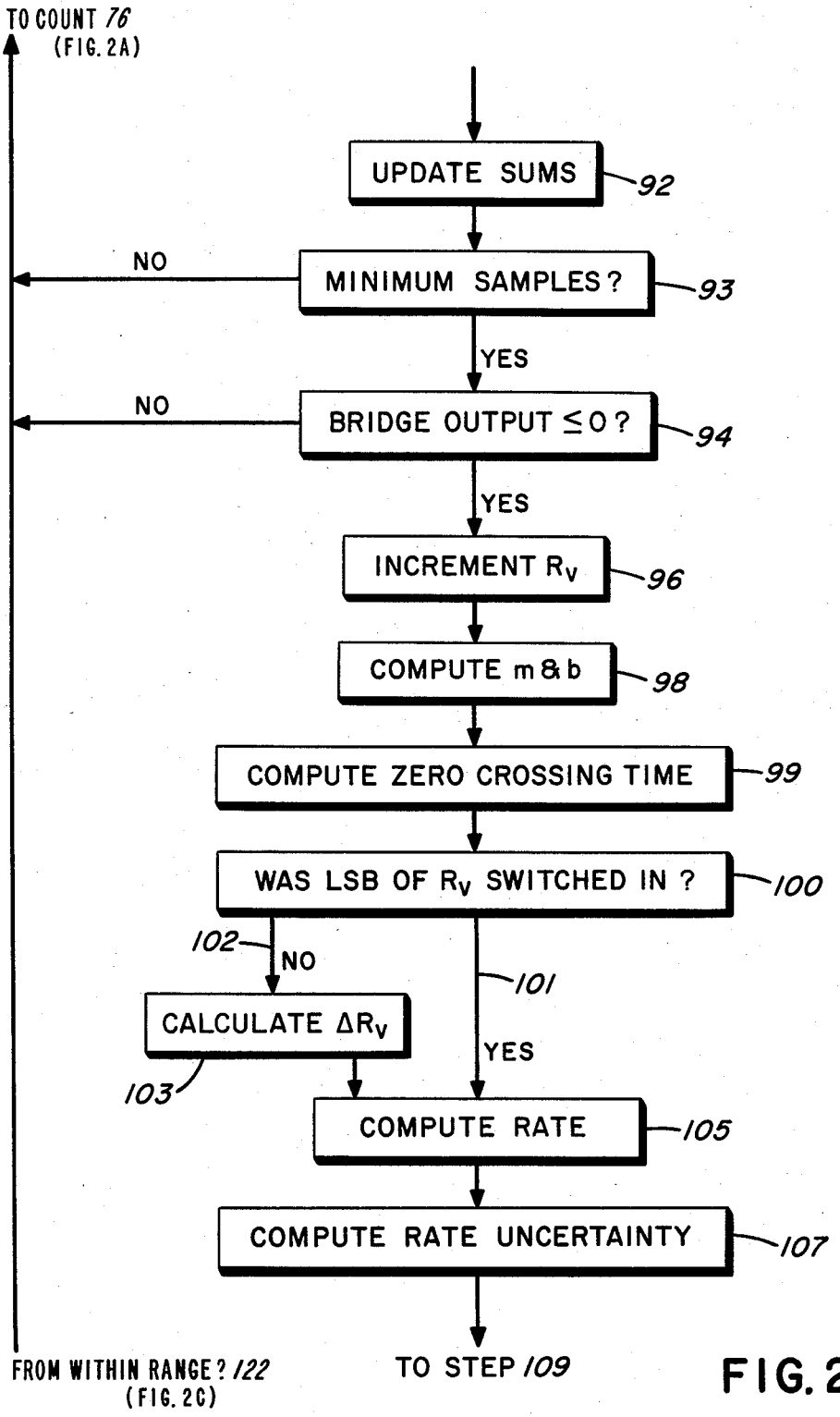
Figure 2C:
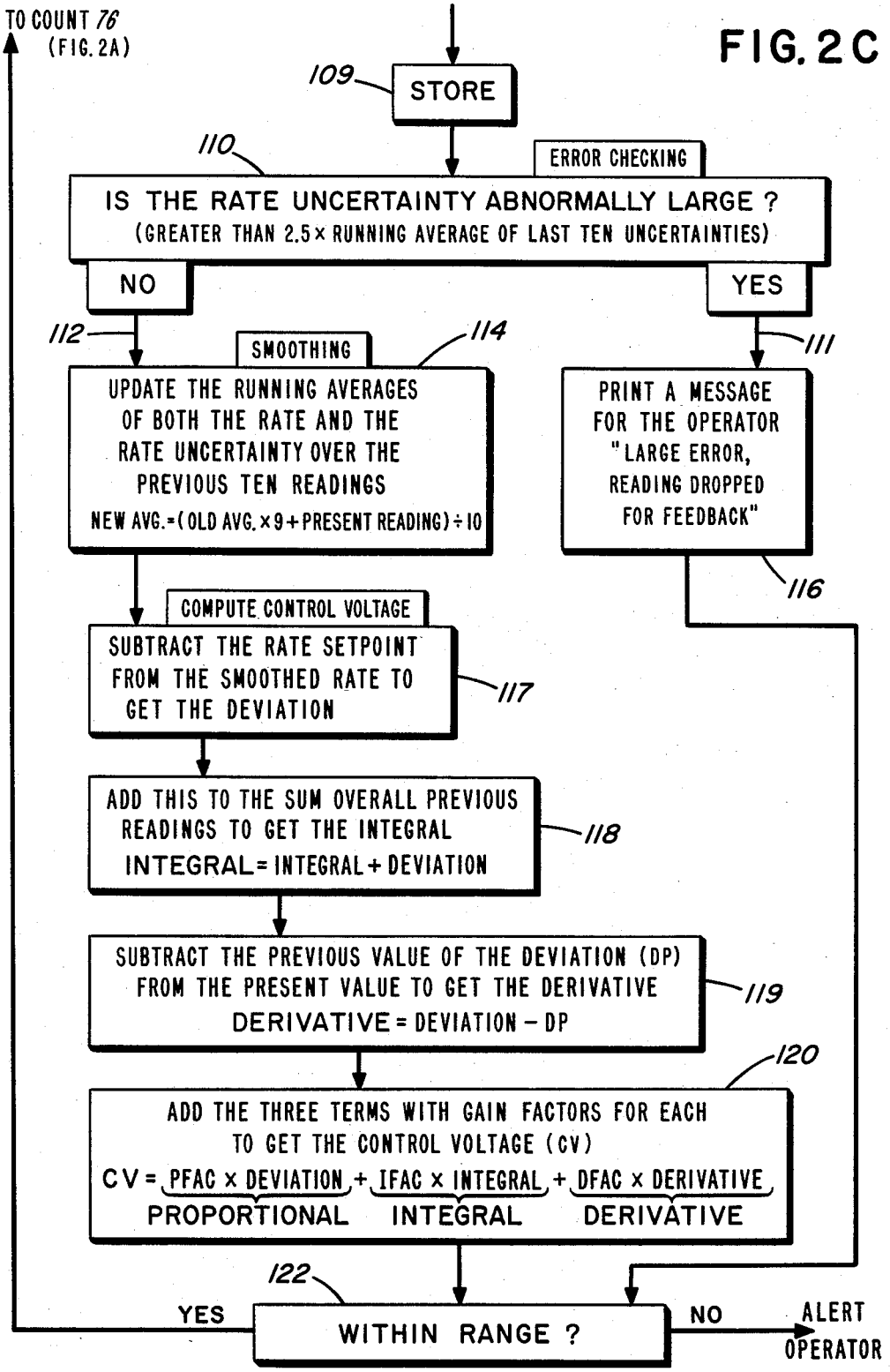

FIGS. 2A through 2C demonstrate the programming steps for computer 46 which will measure the plating rate as well as derive a control signal from the plating rate measurements. Turning now to FIGS. 2A through 2C, much of the programming steps illustrated in these Figures represents the programming of the aforementioned co-pending patent application, and additionally includes the feedback control program 58 of FIG. 1.

The computer 46 executes the program beginning with an initial step 76. Step 76 counts a preselected time interval prior to continuing execution of the program. This delay in execution is approximately 1 second. Next, the computer reads the computer keyboard in step 77 to determine whether any control entries have been made. If the system operator has depressed a key on the keyboard, the control will proceed along path **77*b* to step 80 determining whether an R, F or S key has been selected. In the event one of these three recognizable keys is depressed, control will continue along path 80*a* to determine which of the R, F or S keys have been depressed. In the event that a key other than one included in this group has been selected, the computer control will proceed along path 80*b***.

With the system including the programming of steps 81, 82 and 83, it is possible to provide for two modes of control for the formaldehyde controller. When key S has been depressed, the computer system will display on the CRT a prompting note to the operator to enter a set point value for a plating rate to be established by the system.

Two possible modes of operation for the system are provided with the R and F key depressions. The R depression will instruct the computer in step 81 that the formaldehyde control shall be effected proportional to the measured plating rate. In the event the F key is depressed, the computer will act as a mere conduit to relay the formaldehyde concentration signal provided by the Mark VI-70 controller 60 of FIG. 1 back to the control input of the Mark VI-70 controller 60, thereby having formaldehyde concentration as the controlling factor for replenishing the bath 33.

The computer, after initially setting up in accordance with the operator input commands, selecting the mode of operation and a particular plating rate set point, will proceed to measure the plating rate of the plating solution of bath 33. Analog to digital converter 44 provides an indication of the bridge output voltage to the computer which is measured in step 85. This output voltage is monitored to determine the plating rate. Prior to calculating the plating rate, the program will thereafter select one of two execution paths, 87 or 88, depending on the selected control mode. Execution path 87 will provide a control voltage, computed during a previous execution of the programming steps of FIG. 2C, to the digital to analog converter 59 of FIG. 1. In the instance where formaldehyde concentration is selected as the form of control, the voltage appearing on the Mark VI-70 formaldehyde controller 60, which indicates the formaldehyde concentration, is outputted to the digital to analog converter 59 as the control voltage.

When either of these particular forms of control voltage are selected, the computer proceeds to step 92. Step 92 adds the previous measured bridge output voltage to a statistically summed previous bridge output voltage. As the entire computer program is executed in a 1 second processing time, it is anticipated that 60 independent measurements per minute of the bridge output voltage will be realized. Thus, it is possible during eac one minute interval to have a statistical average of the voltage provided by the wheatstone bridge rate detector 24 of FIG. 1. At the conclusion of a selected 1 minute interval, the computer will make respective summations of the bridge output voltage, and elapsed time, as well as the product of the measured bridge output voltage and elapsed time. With these summations there is derived from a well-known statistical technique, a best fit straight line of these accumulated quantities, for each of the time intervals denoted in the previously filed patent application as "A", "B" and "C" during which a balance of the wheatstone bridge 24 was effected.

The computer thereafter determines, in step 93, whether a minimum number of measurements of the bridge have been taken. This minimum number will be 10 in the usual case. In the event that a minimum number of samples have not been taken, control of the program returns to step 76, and additional measurements are made of the bridge output voltage.

Assuming that the minimum number of samples of the bridge output voltage in step 93 have occurred, program execution continues to step 94 where the birdge output voltage is compared with zero. When the bridge output voltage is approximately zero, the balance condition has been detected for the last increment of $R_\nu$ that was supplied to the reference bridge arm of $R_\nu$ of FIG. 1. At this time, $R_\nu$ is incremented again in step 96 to begin another measurement interval. The sums of measurement voltage obtained in step 91 are used to define a straight line, which approximates the best straight line fit for the accumulated data points. In step 98, the slope and intercept of the straight line of step 92 is determined, which defines a linear characteristic of the voltage provided by the bridge 24 during the time intervals between bridge nulls.

From the straight line approximation of the voltage characteristic, a zero crossing time is determined which will establish a theoretical null point for the bridge. Although the system measures the actual bridge output in step 94, and indicates when a balance condition has been obtained, it is more accurate to compute the zero crossing time in step 99 for the voltage characteristic from the accumulated voltage data points. Thus, any erroneous null detection from the bridge measurement in step 94 will not produce an error in determining the time interval between null points.

Steps 100, 103 and 105 of the programming sequence are implemented to improve the accuracy of the plating rate computation. It will be recalled that the value of $R_\nu$ is incremented after the wheatstone bridge 30 comes into balance. The incrementation of the resistance values is binary. During each even time interval between null balances, the least significant bit of the computer output port which increments the resistance, will have changed from a binary zero to a binary 1, while the states of the remaining bits to the resistance interface 21 have remained the same. When transferring between even and odd time intervals, more than one resistor will be switched into or out of the resistance chain $R_\nu$ which can result in errors in the step increase of the resistance values. Therefore, step 100 detects whether or not the least significant bit has been switched in, identifying the interval as an even or odd interval. If the answer in step 100 is that the least significant bit has been switched in, the rate of plating is computed as was previously described.

In the event that the least significant bit has not been switched, indicating that the transition between time intervals is between an even and an odd interval, a calculated value of $\Delta R_\nu$ is utilized to make the determination of the rate of deposition. This value, $\Delta R_\nu$, is equal to $R_0 \times b/b_p$ wherein R0 is the least significant bit of the resistance change provided by interface 21, $\Delta R_\nu$ is the change of $R_\nu$ occurring at the outset of the last completed odd interval; b is the displaced Y axis intercept occurring at the outset and $b_p$ is the displaced Y axis intercept during a previous even interval.

In step 109, the calculated plating rate is stored, and the corresponding rate uncertainty. The programming step 107 determines if an erroneous rate measurement has been made. Step 107 determines the least square fit of the bridge output voltage versus time to a straight line. Subtracting the fitted straight line value from the individual voltage readings produces a deviation from the ideal. The mean of this squared deviation is the variance and the square root of the variance is the standard deviation or the voltage noise of the system. From this standard deviation the rate uncertainty is determined.

The remaining portion of the programming steps of FIG. 2C calculate an error control voltage for the Mark VI-70 bath controller when plating rate control is selected. In step 111, the stored value of the rate uncertainty is detected and compared within the running average of the last ten uncertainties. In the event that the rate uncertainty determined from the accumulation of rate calculations in step 107, exceeds the given criteria, a message is printed that the error is beyond the bounds of acceptable limits, and a message is printed indicating that the recent rate computation will not be utilized in developing the feedback voltage for controlling formaldehyde replenishment.

In the event that the rate uncertainty is within the established limit, path 112 of the programming cycle will use the determined plating rate to derive a control voltage. In step 114, the running average of the both the plating rate and the plating rate uncertainty over the previous ten readings is calculated.

The first term of the control signal, derived from the plating rate, is obtained in step 117. The rate set point established earlier in step 83, is subtracted from the measured average plating rate determined in step 114.

Step 118 adds to this differential the sum of all the previous deviations obtained from the difference between set point plating rate and measured plating rate to arrive at an integral of the differential.

A derivative term is obtained in step 119 by subtracting the previous value of the obtained deviation from the present value.

These three terms are now summed together, with a gain factor of Pfac, Ifac and Dfac to obtain the control CV which is equal to the following $$CV = Pfac \times \text{DEVIATION} + Ifac \times \text{INTEGRAL} + Dfac \times \text{DERIVATIVE}$$

In step 122, the control voltage is compared with a predetermined level to be certain that it is within range of an expected control voltage.

Assuming that the control voltage is within the expected range, control of the program returns to the beginning point to step 76. The calculated control voltage will be applied to controller 60, depending on the determination made in step 86 which indicates that rate control is to be effected.

Thus, there is described additional programming steps for the computer described in the aforementioned patent application, which will permit the feedback control for formaldehyde replenishment to be affected. The additional programming steps of FIGS. 2A through 2C will permit the operator to select either the rate control, formaldehyde control or change the rate set point. During operation, it is preferable to start the system in a formaldehyde control mode, wherein the computer simply acts as a wire connecting the Mark VI-70 bath controller 60 back to its normal configuration in which a formaldehyde feed rate control voltage is derived from a measurement, provided by the controller 60, of the concentration of formaldehyde in a plating solution sample stream. Once the formaldehyde mode has been established, and the bath begins plating, it is therefore desirable to switch to rate control which can be done on the computer keyboard.

When the feedback algorithm is applied in steps 114 through 120, three gain factors listed, Pfac, Ifac and Dfac, are empirically determined. For optimum control, these gain factor values depend on the type of feed rate control device. These gain factors will be established in accordance with the duty cycle control provided by the formaldehyde controller, the feed line pressure, the size of the plating tank, the surface area being plated and other such factors.

It is contemplated that an additional sophistication to the described system will be implemented by permitting entry of data for modifying these gain factors in accordance with changes in the plating bath conditions. Such will provide additional plating rate quality control.

Thus, there is described a system for implementing the method in accordance with the invention. Those skilled in the art will recognize yet other embodiments of the invention more fully described by the claims which follow.

What is claimed is:

1. A method for controlling plating in an electroless plating process for plating with an additive bath, said bath having a replenishment control for establishing a replenishment rate of a selected bath component comprising:

continuously monitoring the plating rate of said additive bath and generating an electrical current representing said monitored rate;

comparing said monitored rate with a desired rate;

deriving a control voltage from the difference between said measured rate and desired rate; and replenishing said additive bath with said selected bath component as a function of said control voltage.

2. The method of claim 1 wherein said selected bath component is formaldehyde.

3. The method of claim 1 wherein said control voltage is proportional to the difference of said desired rate and measured rate, the integral of said difference, and the derivative of said difference.

4. A method for controlling plating in an electroless plating process for copper plating with an additive bath, said bath having a replenishment control for establishing a concentration of a selected bath component comprising:

continuously monitoring the present plating rate of said additive bath and generating an electric current representing said monitored plating rate;

generating a first feedback control term from said electrical current proportional to the difference between the present plating rate and a desired rate;

generating a second feedback control term proportional to the integral of said first feedback control term;

generating a third feedback term proportional to minus the time derivative of said first feedback control term;

generating a control voltage from said first, second and third feedback control terms; and applying said control voltage to said replenishment control, whereby said concentration is maintained at a predetermined level.

5. The method of claim 4 further comprising:

measuring the uncertainty of said measured plating rate; and posting a message indication when said uncertainty exceeds a predetermined limit.

6. The method of claim 4 wherein said present plating rate is determined by computing an average plating rate from a plurality of consecutive readings.

7. A method for controlling the concentration of a chemical constituent replenished from a reservoir to an electroless plating bath, comprising:

measuring at regular intervals the plating rate of said plating bath;

computing over a plurality of said intervals a running average of a plurality of plating rate measurements;

subtracting a predetermined plating rate set point from the running average plating rate to obtain a plating rate deviation;

forming the summation of said plating rate deviations whereby an integral of said plating rate deviation is obtained;

subtracting the previous value of a determined deviation to a present value of said deviation whereby a derivative of said deviation is determined;

combining said present deviation, integral of said plating rate deviations and derivative of said deviation to obtain a control parameter for said chemical constituent of an electroless plating bath;

generating a control signal proportional to said control parameter; and replenishing said electroless plating bath with said chemical constituent at a rate controlled by said control signal.

8. The method of claim 7 further comprising the method of determining plating rate uncertainty, and posting an error indication when said plating rate uncertainty exceeds a predetermined value.

9. The method of claim 7 further comprising determining the plating rate uncertainty;

comparing said plating rate uncertainty with a predetermined plating rate uncertainty; and, dropping plating rate measurements from any determination of that said uncertainty exceeds said predetermined uncertainty.

* * * * *